US006640763B2

(12) United States Patent
Kawakami et al.

(10) Patent No.: US 6,640,763 B2
(45) Date of Patent: Nov. 4, 2003

(54) APPARATUS FOR CONTROLLING STARTING OF INTERNAL COMBUSTION ENGINE

(75) Inventors: Teruaki Kawakami, Tokyo (JP); Tadahiro Azuma, Tokyo (JP); Keiichi Enoki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 78 days.

(21) Appl. No.: 09/964,695

(22) Filed: Sep. 28, 2001

(65) Prior Publication Data

US 2002/0166529 A1 Nov. 14, 2002

(30) Foreign Application Priority Data

May 14, 2001 (JP) ..... 2001-143241

(51) Int. Cl.[7] ..... F02N 11/08
(52) U.S. Cl. ..... 123/179.3
(58) Field of Search ..... 123/179.3, 179.18, 123/179.4; 290/38 R, 38 D

(56) References Cited

U.S. PATENT DOCUMENTS 4,875,443 A * 10/1989 Sano et al. ..... 123/179.3
4,917,061 A * 4/1990 Nagakura ..... 123/179.3
5,622,148 A * 4/1997 Xue et al. ..... 123/179.25
5,979,158 A * 11/1999 Kaiser et al. ..... 123/179.3

FOREIGN PATENT DOCUMENTS

JP 64-015443 1/1989

* cited by examiner

*Primary Examiner*—Henry O. Yuen
*Assistant Examiner*—Arnold Castro
(74) *Attorney, Agent, or Firm*—Sughrue Mion, PLLC

(57) ABSTRACT

An apparatus for controlling starting of an internal combustion engine is arranged to reduce exhaust emissions and emission variations at engine startup. The starter is driven after a lapse of the predetermined period of time from the moment at which an engine starting command is operated, so that the engine can be started when sensors and actuators attached to the engine are in optimum conditions, thereby reducing exhaust emissions and emission variations. Also, after the engine has been cranked by driving the starter, the starter is stopped after a lapse of the predetermined time from the moment at which the number of engine revolutions becomes equal to or larger than a predetermined number of revolutions. Therefore the engine can be reliably set in a suitably started condition before the starter is turned off even if the engine is in a particular condition, e.g., an extremely-low-temperature condition such that combustion in the engine is unstable and the engine can stall easily.

6 Claims, 3 Drawing Sheets

APPARATUS FOR CONTROLLING STARTING OF INTERNAL COMBUSTION ENGINE

BACKGROUND OF THE INVENTION

1. Field of the Invention

The present invention relates to an apparatus for controlling starting of an internal combustion engine and, more particularly, to an apparatus for controlling starting of an internal combustion engine so as to prevent a deterioration or reduce variation in exhaust emissions at the time of starting.

2. Description of the Related Art

Conventionally, an internal combustion engine is controlled as described below when started. When a driver turns on the ignition system to start an engine, energization of an engine control unit (hereinafter referred to as "ECU") for controlling the engine and various sensors and actuators attached to the engine is started. When the driver thereafter turns on the ignition switch, the starter is directly connected to the battery to crank the engine. When the engine cranks, the ECU controls the engine so that injection of fuel into the cylinders is started and ignition is effected in each cylinder.

In this conventional internal combustion engine starting control process, however, there is a possibility of the sensors and actuators attached to the engine being in conditions different from the optimum conditions if the starter is driven immediately after turning on the ignition system. For example, in a heating coil type of airflow sensor (AFS) provided as a means for measuring the intake air flow rate, the current supplied to the heating coil is controlled so that the temperature difference between air and the hearing coil is constant, and the supplied current is used as a passing air flow rate signal. The current supplied to heat up the heating coil is considerably large immediately after a start of AFS energization at engine startup, for example. In such a situation, the measured flow rate value is larger than the value corresponding to the actual intake air flow rate and there is a possibility of the air/fuel ratio being controlled so that the fuel-air rate is excessively rich and the amount of unburned HC is increased.

The period of time from the moment at which the ignition switch is turned on to the moment at which cranking is started depends on the driver. Because of this fact and the above-described drawback, exhaust emissions can vary considerably when the engine is started.

Ordinarily, the idle speed control (ISC) valve is in a fully opened position before the engine is started. When, after a start of the engine operation, the condition that the engine speed is equal to or higher than a fixed value while the battery voltage is equal to or higher than a fixed level is satisfied, a drive signal is supplied to a stepping motor for adjusting the opening amount of the ISC valve to start control of the intake air flow rate. Therefore, an amount of air larger than the necessary amount is required in at the time of starting and there is a possibility of an excessively large amount of fuel being injected to increase the amount of unburned HC.

Since the emission control has recently been made stricter as in the United States, it is necessary to reduce variations in exhaust emissions as well as to reduce exhaust emissions at the time of starting.

Moreover, the conventional internal combustion engine starting control also has a problem that, in the case of starting at an extremely low temperature, combustion is unstable even after the engine speed has become higher than the speed at which a starting mode is to be determined and there is a possibility of occurrence of an engine stall in such a case.

SUMMARY OF THE INVENTION

In view of the above-described problems of the conventional art, an object of the present invention is to provide an internal combustion engine starting control which stabilizes the output of the airflow meter mainly at startup and optimizes the startup opening amount of the ISC valve and, and which thereby reduces exhaust emissions and emission variations.

To achieve this object, according to the present invention, there is provided an apparatus for controlling starting of an internal combustion engine, comprising a starter for cranking the engine, engine starting command means for outputting an engine starting command for starting the engine, and starter control means for controlling drive of the starter on the basis of the engine starting command.

The starter control means drives the starter after a lapse of a predetermined period of time from the moment at which the engine starting command is input.

The apparatus may be further provided with engine water temperature detection means for detecting the temperature of engine cooling water. The starter control means changes the predetermined period of time according to the temperature of engine cooling water.

At least one sensor is provided in the engine, and the starter control means changes the predetermined period of time on the basis of the time necessary for the output from the sensor to stabilize.

An actuator is provided in the engine, and the starter control means changes the predetermined period of time on the basis of the time required to complete control of the actuator.

The apparatus may be further provided with engine revolution detection means for detecting the number of engine revolutions. The starter is stopped after a lapse of a predetermined period of time from the moment at which the number of engine revolutions becomes equal to or larger than a predetermined number of revolutions.

DESCRIPTION OF THE PREFERRED EMBODIMENT

Figure 1:
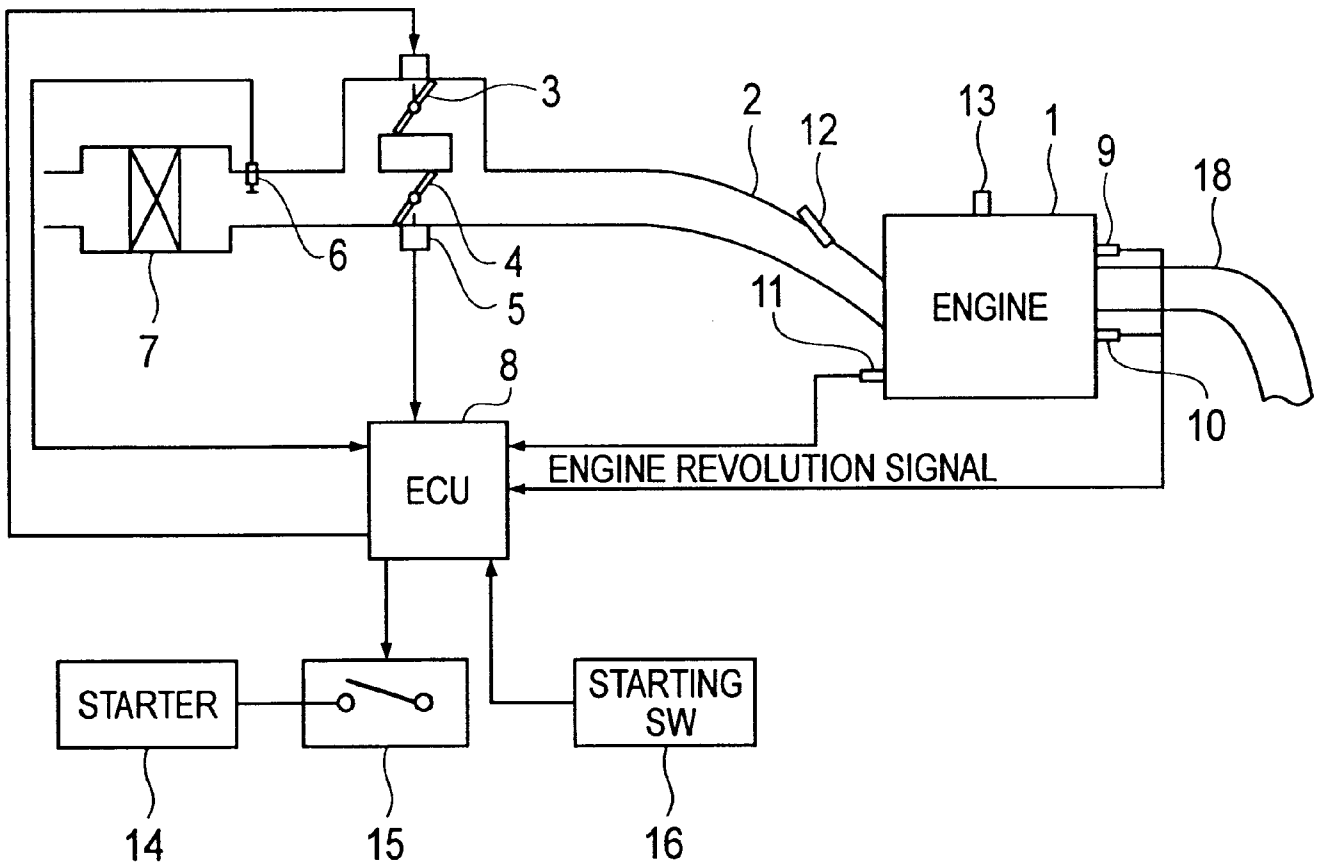
FIG. 1 is a diagram schematically showing an arrangement which includes an internal combustion engine and devices provided around the engine, and to which the present invention is applied.

An embodiment of an apparatus for controlling starting of an internal combustion engine in accordance with the present invention will be described with reference to the accompanying drawings. FIG. 1 illustrates an example of an arrangement which includes an internal combustion engine and devices provided around the engine, and to which the present invention is applied. FIG. 1 illustrates an engine 1, an air intake pipe 2 connected to the engine 1, and an exhaust pipe 18 also connected to the engine 1. Provided in the air intake pipe 2 are, successively from the upstream side, an air cleaner 7 for cleaning intake air, an airflow meter 6 for measuring the intake air flow rate and outputting a signal representing the measured rate to an ECU 8 (described below), a throttle valve 4 operated by a driver, a throttle sensor 5 for measuring the opening amount of the throttle valve 4 and outputting a signal representing the opening amount to the ECU 8, and injectors 12 for injecting a predetermined amount of fuel to the vicinity of intake valves (not shown) of the engine 1. A bypass is also provided in the air intake pipe 2 in parallel with the throttle valve 4, and an ISC valve 3 for controlling the rate at which intake air flows is provided in the bypass, as shown in FIG. 1. The ISC valve 3 is set in a fully opened position before starting of the engine. When, after a start of the engine operation, predetermined conditions are satisfied, a drive signal is supplied from the ECU 8 to a stepping motor for adjusting the opening amount of the ISC valve 3 to start control of the intake air flow rate.

The engine 1 is provided with a cam angle sensor 9 for measuring the number of engine revolutions and outputting an engine revolution signal to the ECU 8, a crank angle sensor 10 for measuring the crank angle and outputting the measured angle to the ECU 8, a water temperature sensor 11 for measuring the temperature of cooling water in the engine 1 and outputting the measured temperature to the ECU 8, and ignition plugs 13 for ignition in the engine 1.

The ECU 8 performs computations for control using the input signals from the respective sensors 9, 10, and 11, etc., and outputs control signals. There are also provided a starter 14 which drives a flywheel (not shown) of the engine 1, a normally open type of relay 15 open/close controlled by the ECU 8, and starting switch (SW) 16 operated by the driver.

Figure 2:
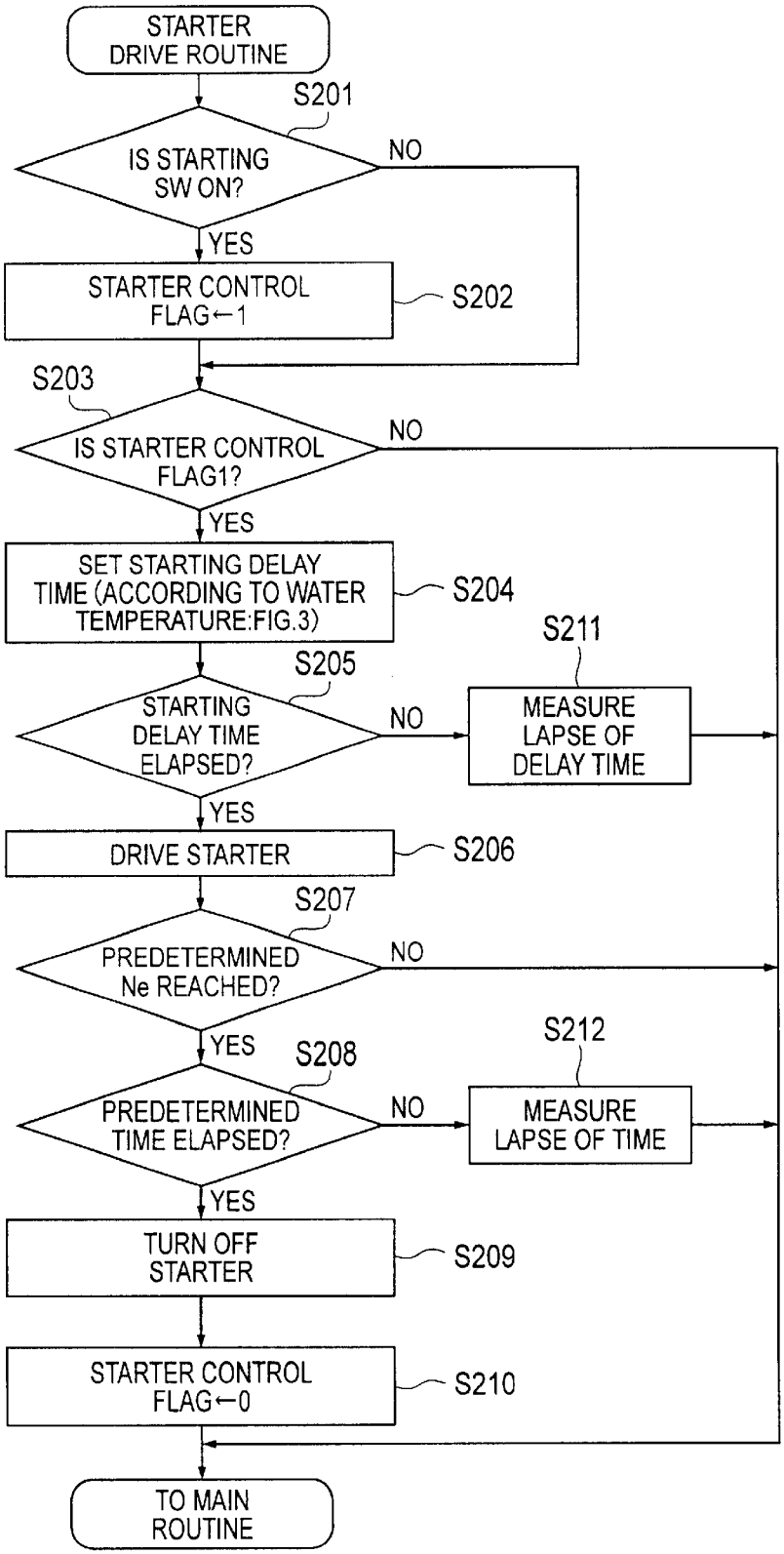
FIG. 2 is a flowchart for explaining the operation of the starting control apparatus of the present invention.

The operation of the internal combustion engine starting control apparatus in accordance with the present invention will be described with reference to the flowchart of FIG. 2. In engine control program for the ECU 8, a starter drive routine shown in FIG. 2 is incorporated along with ordinary routines including those for computation of the amount of fuel to be injected, computation for ignition timing, and computation for ISC control. When the driver turns on the starting switch 16, the engine control program is started to compute the amount of fuel to be injected, ignition timing, an ISC target opening amount, etc., at startup by using the outputs from the AFS and the other various sensors for detecting engine conditions.

Figure 3:
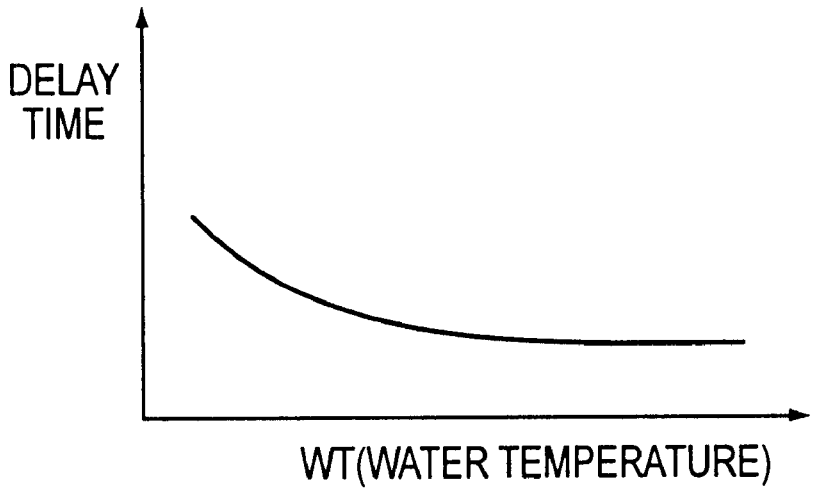
FIG. 3 is a graph showing a setting of a starting delay time through which starting is delayed in the starting control apparatus of the present invention.

In the starter drive routine shown in FIG. 2, when the starting switch 16 is turned on by the driver, a determination is first made in step S201 as to whether or not the starting switch 16 has been turned on. If it is determined that the starting switch 16 has been turned on, a starter control flag is set in step S202 (more specifically, the starter control flag is set to 1). If it is recognized in step S203 that the starter control flag is set, starter control is started. In starter control, a starting delay time is first set in step S204. The starting delay time is set, for example, on the basis of data such as shown in FIG. 3 with respect to the engine cooling water temperature. In step S205, a determination is made as to whether or not the predetermined period of time corresponding to the starting delay time has elapsed. If the predetermined period of time has not yet elapsed, a lapse of time is measured as starting delay time in step S211. If the predetermined period of time has elapsed, the starter is driven in step S206. Before the lapse of the predetermined time as starting delay time, the outputs from the AFS sensors, etc., are stabilized and control of actuators including setting of the starting ISC opening amount is also performed. Therefore engine starting control can be initiated when the devices are in a condition most suitable for starting of the engine, that is, when the outputs sensors are stabilized and/or control of the actuators is completed, thereby reducing exhaust emissions and emission variations at engine startup.

In step S206, the starter is driven to crank the engine, and fuel injection and ignition are effected according to the crank angle. If it is determined in step S207 that the number of engine revolutions becomes equal to or larger than a predetermined number of revolutions (Ne), the lapse of time from the moment at which this determination is made is measured (steps S208 and S212). If it is determined in step S208 that a predetermined time has elapsed, the starter drive is turned off in step S209, thereby completing starter control. The starter flag is then initialized in step S210 (more specifically, the starter flag is set to 0). Thus, the state of the engine having the predetermined number of revolutions during the predetermined period of time is determined as a stabilized state of the engine, thereby enabling reliable starting of the engine even at an extremely low temperature with substantially no possibility of an engine stall.

According to the present invention, as described above, the starter 14 for cranking the engine 1, the engine starting command means (starting switch 16) operated by a driver, and the starter control means (ECU 8) for controlling drive of the starter 14 on the basis of an engine starting command output from the engine starting command means are provided to enable the starter to be driven in a way most suitable for starting the engine.

The starter 14 is driven after a lapse of the predetermined period of time from the moment at which the engine starting command is input (step S205). Thus, the engine 1 can be started when the sensors and actuators attached to the engine 1 are in optimum conditions, thereby reducing exhaust emissions and emission variations.

The above-mentioned predetermined period of time is changed according to the engine cooling water temperature. Therefore, even though the operating times of the actuators are changed due to a change in water temperature, the engine 1 can always be started while the sensors and the actuators are in optimum conditions, thereby reliably reducing exhaust emissions.

Since the starter 14 is stopped after a lapse of the predetermined time from the time when the number of engine revolutions becomes equal to or larger than the predetermined number of revolutions, the engine can be reliably set in a suitably started condition before the starter is turned off even if the engine is in a particular condition, e.g., an extremely-low-temperature condition such that combustion in the engine is unstable and the engine is liable to stall.

The present invention provides an internal combustion engine starting control apparatus having a starter for cranking an engine, engine starting command means for outputting an engine starting command for starting the engine, and starter control means for controlling drive of the starter on the basis of the engine starting command. The apparatus thus arranged can drive the starter in a way most suitable for starting the engine.

The starter control means is arranged to perform control such that the starter is driven after a lapse of a predetermined time from the moment at which the engine starting command is input, so that the engine can be started when the sensors and actuators attached to the engine are in optimum conditions, thereby reducing exhaust emission and emission variations.

An engine water temperature detection means for detecting the temperature of engine cooling water is also provided. The starter control means changes the above-mentioned predetermined time according to the temperature of engine cooling water. Therefore, even though the operating times of the actuators are changed due to a change in the water temperature, the engine can always be started while the sensors and the actuators are in optimum conditions, thereby reducing exhaust emissions.

One or more sensors are provided in the engine and the starter control means changes the above-mentioned predetermined time according to the period of time necessary for the outputs from the sensors to stabilize. Therefore, even though the operating times of the actuators are changed due to a change in the water temperature, the engine can always be started while the sensors and the actuators are in optimum conditions, thereby reducing exhaust emissions.

Also the actuators are provided in the engine and the starter control means changes the above-mentioned predetermined time according to the period of time required to complete control of the actuators. Therefore, even though the operating times of the actuators are changed due to a change in the water temperature, the engine can always be started while the sensors and the actuators are in optimum conditions, thereby reducing exhaust emissions.

An engine revolution detection means for measuring the number of revolutions of the engine is further provided. The starter is stopped after a lapse of the predetermined time from the time when the number of engine revolutions becomes equal to or larger than a predetermined number of revolutions. Therefore the engine can be reliably set in a suitably started condition before the starter is turned off even if the engine is in a particular condition, e.g., an extremely-low-temperature condition such that combustion in the engine is unstable and the engine can stall easily.

What is claimed is:

1. An apparatus for controlling starting of an internal combustion engine, comprising:

a starter for cranking the engine;

engine starting command means for outputting an engine staffing command for starting the engine; and starter control means for controlling drive of said starter on the basis of the engine starting command, wherein said starter control means drives said starter after a lapse of a predetermined period of time from the moment at which the engine starting command is input, and further wherein at least one sensor is provided in the engine, and said starter control means changes the predetermined period of time on the basis of the time necessary for the output from the sensor to stabilize.

2. An apparatus according to claim 1, wherein said sensor is an intake-air flow sensor.

3. An apparatus according to claim 1, further comprising engine water temperature detection means for detecting the temperature of engine cooling water, wherein said starter control means changes the predetermined period of time according to the temperature of engine cooling water.

4. An apparatus for controlling starting of an internal combustion engine, comprising:

a starter for cranking the engine;

engine starting command means for outputting an engine starting command for starting the engine; and starter control means for controlling drive of said starter on the basis of the engine starting command, wherein said starter control means drives said starter after a lapse of a predetermined period of time from the moment at which the engine starting command is input, and wherein an actuator is provided in the engine, and said starter control means changes the predetermined period of time on the basis of the time required to complete control of the actuator.

5. An apparatus for controlling starting of an internal combustion engine, comprising:

a starter for cranking the engine;

engine starting command means for outputting an engine starting command for starting the engine;

starter control means for controlling drive of said starter on the basis of the engine starting command; and engine revolution detection means for detecting the number of engine revolutions, wherein said starter is stopped after a lapse of a predetermined period of time from the moment at which the number of engine revolutions becomes equal to or larger than a predetermined number of revolutions, wherein said predetermined period of time is based on an engine operating condition.

6. An apparatus according to claim 5, wherein said engine operating condition is a temperature of engine cooling water.

* * * * *